US008783374B2

(12) United States Patent
Rains et al.

(10) Patent No.: US 8,783,374 B2
(45) Date of Patent: Jul. 22, 2014

(54) FIRE EXTINGUISHING FOAM, METHODS AND SYSTEMS

(76) Inventors: Alvin Rains, Stillwater, OK (US); Shan L. Rains, Stillwater, OK (US)

( * ) Notice: Subject to any disclaimer, the term of this patent is extended or adjusted under 35 U.S.C. 154(b) by 225 days.

(21) Appl. No.: 13/317,755

(22) Filed: Oct. 28, 2011

(65) Prior Publication Data

US 2012/0103639 A1 May 3, 2012

Related U.S. Application Data

(60) Provisional application No. 61/455,962, filed on Oct. 29, 2010.

(51) Int. Cl.
*A62C 3/06* (2006.01)
*A62D 1/00* (2006.01)

(52) U.S. Cl.
CPC ..... *A62D 1/0035* (2013.01)
USPC ..... 169/46; 169/45

(58) Field of Classification Search
USPC ..... 169/46, 43, 44, DIG. 2; 252/3, 606
See application file for complete search history.

(56) References Cited

U.S. PATENT DOCUMENTS 3,945,962 A * 3/1976 Clark ..... 524/99
4,042,522 A 8/1977 Falk
4,090,967 A 5/1978 Falk
4,306,979 A 12/1981 Tsuji
4,359,096 A 11/1982 Berger
4,464,267 A * 8/1984 Chiesa et al. ..... 252/3
5,085,786 A 2/1992 Alm et al.
5,207,932 A 5/1993 Norman et al.
5,218,021 A 6/1993 Clark et al.
5,438,096 A * 8/1995 Wang et al. ..... 524/832
5,616,273 A 4/1997 Clark et al.
5,998,521 A 12/1999 Fan et al.
6,015,838 A 1/2000 Stern et al.
6,019,176 A * 2/2000 Crouch ..... 169/46
6,478,979 B1 11/2002 Rivers et al.
6,849,194 B2 2/2005 Robin et al.
7,011,763 B2 3/2006 Clark
7,216,722 B2 5/2007 Sharma et al.
7,223,351 B2 5/2007 Sharma et al.
7,476,346 B2 1/2009 Hagquist et al.

* cited by examiner

*Primary Examiner* — Justin Jonaitis

(57) ABSTRACT

An improved fire extinguishing, suppressing, and preventing mixture, method, and system for various classifications of fires which exhibits superior characteristics to knock down the fire, helps to prevent flash and re-ignition, and contains only a trace amount of fluorochemicals. When the mixture is spread on burning surfaces, including fuel and other liquid surfaces, the agent suppresses vaporization, extinguishes flames and helps to suppress re-ignition and reflash of the fire. The mixture is friendly to the environment. It causes no harmful reaction to a burn victim and aids in cooling the victim to slow the burning of skin. The mixture can be washed off a bum victim with soap and water. Other embodiments are described herein.

6 Claims, No Drawings

FIRE EXTINGUISHING FOAM, METHODS AND SYSTEMS

CROSS-REFERENCE TO RELATED APPLICATIONS

This application claims the benefit of provisional patent application Ser. No. 61/455,962 filed Oct. 29, 2010 by the present inventors.

FEDERALLY SPONSORED RESEARCH OR DEVELOPMENT

Not Applicable

SEQUENCE LISTING OR COMPUTER PROGRAM

Not Applicable

BACKGROUND

1. Field of Invention

The present invention relates in general to the field of fire extinguishment, prevention and suppression.

2. Background of the Invention

There are many fire extinguishing agents and methods for using the same. Some fire extinguishing agents operate by inerting or diluting mechanisms that deprive the fire of necessary chemicals, such as oxygen or fuels. Other agents chemically extinguish the fire, some by scavenging free radicals, thereby breaking the reaction chain required for combustion. Still others operate thermally to cool the fire.

Foams used for fire suppression include synthetic foams, aqueous film forming foams (AFFF), fluoroprotein foam, film forming fluoroprotein foam, and protein foams. There are many variations of components within each group. Some foams include an alcohol-resistant concentrate (ARC) such as a polymer that forms a protective layer between the burning surface and the foam which prevents foam breakdown by alcohols in burning fuel.

One of the most effective fire extinguishing agents, particularly for extinguishing flammable liquid fires such as fuel fires, is aqueous film forming foam (AFFF). This is a concentrated liquid which is diluted with water and applied to various classes of fires as a fire extinguishing agent. Upon application of the AFFF, the mixture becomes a foam and spreads over and floats on the surface of burning liquid. The agent contains a surfactant which reduces the surface tension of aqueous solutions to such a degree that the solution spreads upon a surface, such as gasoline, forming a vapor-sealing film which extinguishes the fire. The film also secures non-ignited areas and prevents ignition in those areas.

However, the prior art requires various components that are harmful to the environment, pose health threats, or allow flash and reignition.

Fire extinguishing agents formerly contained components (i.e. bromine-containing compounds such as Halon 1301) that were effective in fire fighting but were harmful to the ozone layer. Recognizing the dangers posed by the use of halons, the world community, through the Montreal Protocol, agreed to phase out halons. As a result, alternatives were developed that included fluorochemicals and inert gases.

However, the fire fighting foams containing fluorocarbons or other fluorochemicals are relatively inefficient. For example, U.S. Pat. Nos. 4,042,522 and 4,090,967 to Falk, U.S. Pat. No. 5,616,273 to Clark et al., U.S. Pat. No. 6,478, 979 to Rivers, et al., U.S. Pat. No. 6,849,194 to Robin et al., U.S. Pat. No. 7,011,763 to Clark, and U.S. Pat. Nos. 7,216, 722 and 7,223,351 to Sharma et al. describe AFFFs or agents of fire extinguishing compositions that contain fluorochemicals. Fluorocarbons can react in the flame to form decomposition products that pose a significant health threat. Fluorochemical surfactants have come under the scrutiny by the Environmental Protection Agency (EPA) and environmental organizations. For example, the EPA determined that perfluorooctanesulfonate posed a long-term threat to the environment after long-term studies of the agent were animal tested. The EPA has initiated other programs designed to evaluate potential environmental problems from other fluorochemical surfactants in the marketplace.

Another disadvantage of using fluorocarbons in fire extinguishing agents is that these chemicals react in the flame to form decomposition products that are corrosive to equipment and pose further health threats. It is desirable to preserve any equipment or machines on fire to the extent possible and to minimize any health threats from the fire fighting agent. Moreover, a less corrosive agent can be used in light weight containers made from substances such as aluminum instead of heavy, non-corrosive alloys.

Still other fire extinguishing agents contain inert gases such as nitrogen or argon and blends thereof which require large amounts of such gases to put out a fire because the agents are very inefficient at fire extinguishing. This creates a need for a large number of storage cylinders to store the agent and large storage spaces to house the cylinders. Furthermore, these agents are dangerous to people in proximity to the fire as the agents take away the oxygen in a confined space.

The prior art teaches fire fighting agents to blanket the surface of the flame and cut off oxygen to the flame. For example, see U.S. Pat. No. to Berger and U.S. Pat. No. 6,478, 979 to Rivers. If the surface of the fire extinguishing product is broken, the fire will flash and reignite. This is true with both AFFF and ARC products.

As a result of the disadvantages of using the prior art in fire fighting, it is desirable to have fire extinguishing products that contain only a trace amount of fluorochemicals are not detrimental to human health or the environment, are inexpensive, and are easy to store. Moreover, it is desirable that improved fire extinguishing agents be developed that minimize re-ignition of the fire after application of the fire extinguishing agent.

Operation

SUMMARY OF THE INVENTION

In one embodiment, the invention provides a fire extinguishing mixture that includes diethylene glycol monobutyl ether C4H9O(CH2CH2O)2H (less than 1%), an antimicrobial preservative, C9H16CIN4CL (preferably Dowacil ™ 75 brand, sold by The Dow Chemical Company, Midland, Mich.), and polyethylene glycol octylphenol ether, which is a non-ionic surfactant.

DETAILED DESCRIPTION

Preferred Embodiment

One embodiment of the fire fighting foam is comprised equal parts of:

(1) A 3%-6% Alcohol Resistant Concentrate mixture (with a non-ionic surfactant) preparation comprised of:

(a) diethylene glycol monobutyl ether (C4H9O (CH2CH2O)2H (less than 1%)), such as Ansulite® (manufactured by Ansul Incorporated, Mariette, Wisconsin), with a concentration of Wt %: 15%, and (b) methenamine 3-chloroallylochloride (C9H16CIN4CL), an antimicrobial preservative (preferably Dowacil ™ 75 brand, sold by The Dow Chemical Company, Midland, Mich.) with a concentration of Wt %: 0.015%, and (2) polyethylene glycol octylphenol ether (a 3%-6% Alcohol Resistant Poly Glycol Non-Ionic Surfactant), such as Cold Clean 500 (manufactured by Essex Fire & Safety Company, Inc., Houston, Tex.) with a concentration of Wt %: 100%, as a surfactant combined with clean tap water at the ratio of 1 part mixture to 23 parts clean tap water.

Water is combined with the mixture when loaded into a fire extinguisher or when used with an inductor system. The invention maintains its effectiveness in fighting fires and preventing re-ignition while requiring only a trace amount of fluorochemical surfactants. It is therefore is less toxic than existing products, safer for the environment and the people in the vicinity of its use. It causes no harmful reaction to a burn victim and aids in cooling the victim to slow the burning of skin. The mixture can be washed off a burn victim with soap and water.

The invention is water soluble. It is blue-green in color and has a pleasant aroma.

The invention can be used for fires in a variety of classifications: Class A (ordinary combustible materials), Class B (flammable liquids), Class C (electrical equipment that is non-energized), and Class K (cooking oils).

The invention operates in three different ways to eliminate fires. First, the invention blankets the surface of the fire and thereby shuts off the oxygen supply. Second, the water cools and quenches, lowering the ignition temperature. Third, the invention prevents the fire from re-igniting by breaking down the hydrocarbon chain.

The agent penetrates porous substances such as cotton and foam to extinguish deep seated fires such as mattresses, furniture, clothing and automobile upholstery. This invention also works on pools of flammable liquids. As the agent is applied, it will build up on most upright non-slick surfaces, causing the agent to adhere and prevent the fire from spreading. With respect to Class B fires and Class K fires, the invention breaks down the hydrocarbons and thereby renders the fire into a non-burnable state so that the product will not flash and re-ignite.

By preventing re-ignition, the invention has novel uses such as allowing firefighters and rescue crews to safely work in situations in which they must walk through a burning area or onto a surface covered with a flammable liquid and the invention in order to fight a fire or rescue people.

For example, when used in an automobile collision involving a fuel spill, the invention aids in the extinguishment of the fire and is not harmful to the vehicle occupants. The composition may be applied directly to a burn victim without adverse effects; it aids in cooling the burn victim to slow the burning of skin. The invention and can be washed off with soap and water.

After spraying the invention on the spilled fuel, emergency personnel can safely walk back and forth over the area to the vehicle and its occupants without risking an ignition or reignition of fire. When the proper ratio of product to fuel is used, the invention prevents the flash and reignition of a fire because it breaks down hydrocarbons and other flammable substances and renders the fire into a non-burnable state.

With existing products, a footstep onto a product-covered fuel spill causes the surface tension of the agent to break and the fuel to be exposed to oxygen, giving rise to a possible flash and re-ignition of the fire. This puts rescue crews, vehicle occupants, and any others in the vicinity of a fire at risk for injury.

Alternative Embodiments

Alternative embodiments of the invention include using octylphenoxypolyethoxyehtanol, (a 3%-6% Alcohol Resistant Poly Glycol Non-Ionic Surfactant), such as Petro-Green ADP-7 (manufactured by Petro-Green, Inc., Dallas, Tex.) with a concentration of Wt %: 100%, instead of polyethylene glycol octylphenol ether as a surfactant in the combination.

Further alternative embodiments of the invention include using lake or pond water instead of tap water in the composition. This ability gives greater flexibility and range of use in locations where tap water is not available.

Furthermore, the antimicrobial preservative component can be hexamethlenetetramine chloroallyl choloride, 1-(3-chloroallyl)-3,5,7-triaza-azoniaadamantane chloride, or the functional equivalent known by another name.

The mixture has met a long-felt, but unsolved need in the fire fighting industry. Being environmental-friendly and providing for the ability to step into the foam-covered fuel is surprising in the field of fire fighting foams. The ability to break down hydrocarbons, rendering the fire into a non-burnable state by preventing flash and re-ignition is a significant capability.

Advantages

The invention is more easily produced than existing fire fighting foams. Moreover, this foam is less corrosive than existing products.

While some foams are limited to one or two types of fires on which they can be used, the invention can be used for fires in a variety of classifications: Class A (ordinary combustible materials), Class B (flammable liquids), Class C (electrical equipment that is non-energized), and Class K (cooking oils).

When the proper ratio of product to fuel is used, the invention prevents the flash and reignition of a fire because it breaks down hydrocarbons and other flammable substances and renders the fire into a non-burnable state. Existing products do not provide this safety feature.

With existing products, a footstep onto a product-covered fuel spill causes the surface tension of the agent to break and the fuel to be exposed to oxygen, giving rise to a possible flash and re-ignition of the fire. This puts rescue crews, vehicle or room occupants, and any others in the vicinity of a fire at risk for injury. However, after spraying the composition on spilled fuel, emergency personnel can safely walk back and forth over the area to the vehicle or room and its occupants without risking an ignition or reignition of fire.

Conclusions, Ramifications, and Scope

The reader will see that at least one embodiment of the foam provides an AFFF that breaks down hydrocarbons and other flammable substances and renders the fire into a non-burnable state in a manner superior to other foams. Use of the foam allows emergency personnel to safely walk back and forth over the area without risking an ignition or reignition of fire. The foam is lightweight, easy to use, and environmental-friendly.

While the description above contains many specificities, these should not be construed as limiting the scope of the embodiment but as merely providing illustrations of some of the presently preferred embodiments. For example, the antimicrobial preservative component can be an agent known as hexamethlenetetramine chloroallyl choloride, or the functional equivalent.

Thus the scope of the embodiments should be determined by the appended claims and their legal equivalents, rather than by the examples given.

What is claimed is:

1. A fire extinguishing, suppressing, or preventing composition comprising at least four components:

(a) diethylene glycol monobutyl ether C4H9O (CH2CH2O)2H, and (b) an antimicrobial preservative, and (c) polyethylene glycol octylphenol ether surfactant, and (d) fresh water whereby an environment-friendly mixture to suppress vaporization, extinguish flames and suppress re-ignition and reflash of fire is provided.

2. The composition of claim 1, wherein said surfactant comprises octylphenoxypolyethoxyethanol.

3. A method for one or more of extinguishing, suppressing or preventing a fire in a space by introducing to the space a composition comprising at least four components:

(a) diethylene glycol monobutyl ether C4H9O (CH2CH2O)2H, and (b) an antimicrobial preservative, and (c) polyethylene glycol octylphenol ether surfactant, and (d) fresh water.

4. The method of claim 3 wherein said surfactant comprises octylphenoxypolyethoxyethanol.

5. A fire extinguishing, preventing or suppressing system configured to introduce to a space a composition comprising at least four components:

(a) diethylene glycol monobutyl ether C4H9O (CH2CH2O )2H, and (b) an antimicrobial preservative, and (c) polyethylene glycol octylphenol ether surfactant, and (d) fresh water.

6. The system of claim 5 wherein said surfactant comprises octylphenoxypolyethoxyethanol.

* * * * *